United States Patent [19]

Engel et al.

[11] 4,015,534

[45] Apr. 5, 1977

[54] EXPLOSIVE PROJECTILE WITH PROJECTILE BODY

[75] Inventors: Walter Engel, Dubendorf; Werner Senn, Zurich; Max Steinemann, Winterthur, all of Switzerland

[73] Assignee: Werkzeugmaschinenfabrik Oerlikon-Buhrle AG, Zurich, Switzerland

[22] Filed: Aug. 16, 1976

[21] Appl. No.: 714,920

Related U.S. Application Data

[63] Continuation of Ser. No. 533,286, Dec. 16, 1974, abandoned.

[52] U.S. Cl. ..... 102/87; 102/60

[51] Int. Cl.[2] ..... F42B 11/16

[58] Field of Search ..... 102/6, 66, 60, 87, 90, 102/93

[56] References Cited

UNITED STATES PATENTS

| | | | |
|---|---|---|---|
| 809,988 | 1/1906 | Semple | 102/87 |
| 823,953 | 6/1906 | Meigs et al. | 102/60 |
| 835,714 | 11/1906 | Semple | 102/60 |
| 1,159,653 | 10/1915 | Cushing | 102/87 |
| 2,452,072 | 10/1948 | Sehatz | 102/60 X |
| 2,504,163 | 4/1950 | Summerbell | 102/87 X |
| 3,551,972 | 1/1971 | Engel | 102/87 X |

FOREIGN PATENTS OR APPLICATIONS

| | | | |
|---|---|---|---|
| 709,843 | 6/1954 | United Kingdom | 102/60 |

*Primary Examiner*—Harold Tudor
*Attorney, Agent, or Firm*—Werner W. Kleeman

[57] ABSTRACT

An explosive projectile which comprises a projectile body possessing a hollow compartment for receiving an explosive charge, a rear end surface, a border ring extending rearwardly from the rear end surface. A tracer composition sleeve is secured to the projectile body and possesses a front end surface which sealingly bears at the rear end surface of the projectile body. At least one of said rear end surface of the projectile body and said front end surface of the tracer composition sleeve having a substantially disc-shaped recess forming a substantially ring-shaped sealing contact surface between such rear and front end surfaces.

3 Claims, 3 Drawing Figures

EXPLOSIVE PROJECTILE WITH PROJECTILE BODY

CROSS-REFERENCE TO RELATED CASE

This is a continuation application of our commonly assigned U.S. applicaton Ser. No. 533,286, filed Dec. 16, 1974, now abandoned and entitled "EXPLOSIVE PROJECTILE WITH PROJECTILE BODY."

BACKGROUND OF THE INVENTION

The present invention relates to a new and improved construction of explosive projectile with a projectile body having a hollow compartment for receiving an explosive charge and a tracer composition sleeve which is sc. ed at the projectile body, the projectile body possessing a notch groove for the attachment of a cartridge sleeve at the projectile body.

According to a known explosive charge of this type the notch groove is located at the region of the tracer composition and the tracer composition sleeve extends into the rear end of the projectile body. In this way the hollow compartment of receiving the explosive charge becomes considerably reduced in size. This is apparent from the accompanying drawings — FIGS. 1 and 3— in which the prior art projectile (FIG. 3) has been illustrated on the same scale adjacent the one inventive projectile (FIG. 1).

SUMMARY OF THE INVENTION

The present invention aims at the provision of an explosive projectile with a larger explosive charge, without considerably increasing the weight of the projectile and without changing the ballistic properties, in that the projectile body and the tracer composition sleeve are of lighter construction.

Another object of the invention resides in the fact that with the same length of the cartridge there is established a reliable connection between the projectile body and the tracer composition sleeve with as small as possible weight of the projectile.

The inventive projectile is manifested by the features that it comprises a projectile body possessing a hollow compartment for receiving an explosive charge, a notch groove for the attachment of a cartridge sleeve at the region of the explosive charge, a rear end surface, and a border ring substantially coaxial with the projectile body and extending rearwardly from the rear end surface thereof. A tracer composition sleeve is secured to the projectile body and possesses a front end surface which sealingly bears at the rear end surface of the projectile body, and a flange at said front end surface with a substantially conical part surrounded by said border ring for interconnecting the projectile body and the tracer composition sleeve. At least one of said rear end surface of the projectile body and said front end surface of the tracer composition sleeve have a substantially disc-shaped recess forming a substantially ring-shaped sealing contact surface between such rear and front end surfaces. The disc-shaped recess can be provided in the rear end surface of said projectile body or in the front end surface of said tracer composition sleeve.

BRIEF DESCRIPTION OF THE DRAWINGS

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
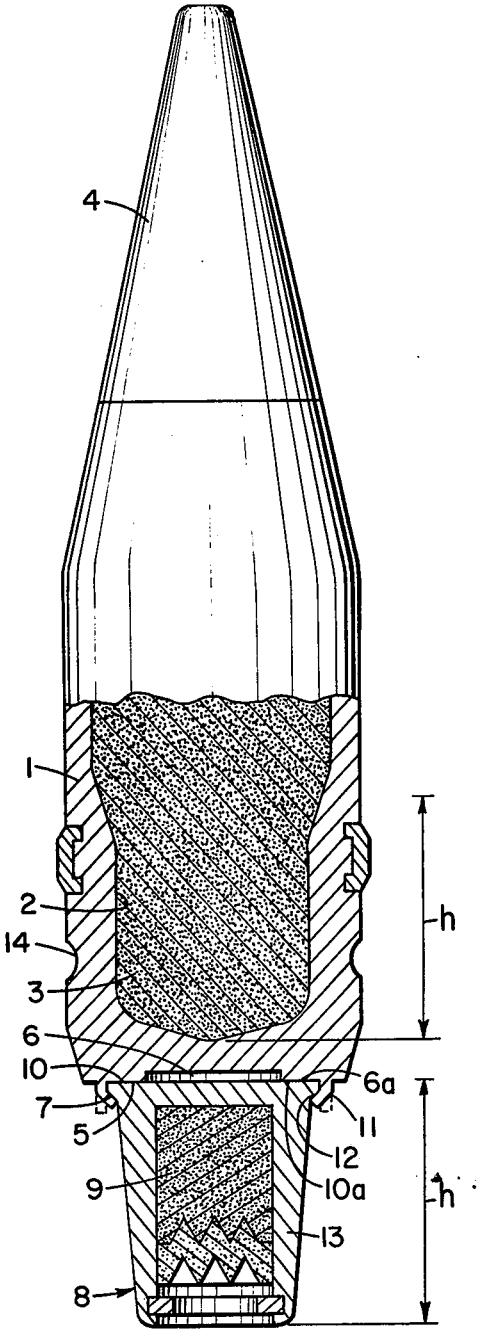
FIG. 1 is a longitudinal sectional view through a projectile according to a first exemplary embodiment of the present invention.

According to FIG. 1 a projectile body 1 possesses a hollow compartment or chamber 2 which opens towards the front. The hollow compartment 2 is filled with an explosive charge 3. A detonator 4 is secured to the front end of the projectile body. The rear end face or surface 5 of the projectile body 1 extends perpendicular to the lengthwise axis of the explosive projectile and possesses a flat, disk-shaped recess 6 forming a substantially ring-shaped sealing contact surface 6*a*. A flanged or border ring 7 which is coaxial to the projectile body 1 extends from the rear end face 5 towards the rear. The flanged ring 7, prior to the attachment of a tracer composition sleeve, which will be described more fully hereinafter, is of substantially hollow cylindrical configuration, as has been illustrated in FIG. 1 with broken lines.

The sleeve 8 contains a tracer composition 9 and possesses a floor or bottom with an end surface 10 which is directed perpendicular to the axis of the projectile. The front end 11 of the tracer composition sleeve 8 is substantially cylindrical and its diameter is equal to the internal diameter of the non-deformed border or flanged ring 7. At this cylindrical part 11 there merges a conical part 12 and a sleeve portion 13 which slightly conically tapers towards the rear. The front end surface 10 of the tracer composition sleeve 8 bears near its periphery by means of a ring-shaped contact portion 10*a* against the ring-shaped sealing contact surface 6*a* at the rear end face or surface 5. The tracer composition sleeve 8 is centered at the flanged or border ring 7. The rear part of the flanged or border ring 7 is flexed inwardly and bears against conical part 12 of the tracer composition sleeve 8, so that the latter is positively connected with the projectile body 1 and tightly bears against the ring-shaped sealing contact surface 6*a*.

Upon passage of the explosive projectile through the weapon barrel the tracer composition sleeve 8 is loaded by a large gas pressure. There thus prevails between the tracer composition sleeve 8 and the ring-shaped rear end surface 5 of the projectile body 1 a high specific surface compression. Consequently, there is prevented gas from penetrating into the disc-shaped recess 6 and thereby there is prevented that the tracer composition sleeve 8 will separate from the projectile body 1.

Figure 2:
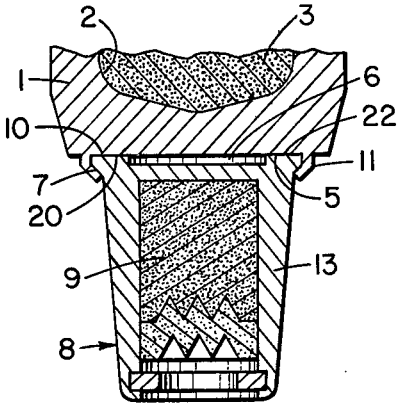
FIG. 2 illustrates a part of the arrangement of FIG. 1 according to a second exemplary embodiment.

The disc-shaped recess 6, according to the second exemplary embodiment of FIG. 2, can be arranged in the tracer composition sleeve 8 instead of in the projectile body 1. Thus here the ring-shaped sealing contact surface 20 is located at the tracer composition sleeve 8 and bears at the opposite situated peripheral ring-shaped region 22 of the rear end face 5 of the projectile body 1.

Figure 3:
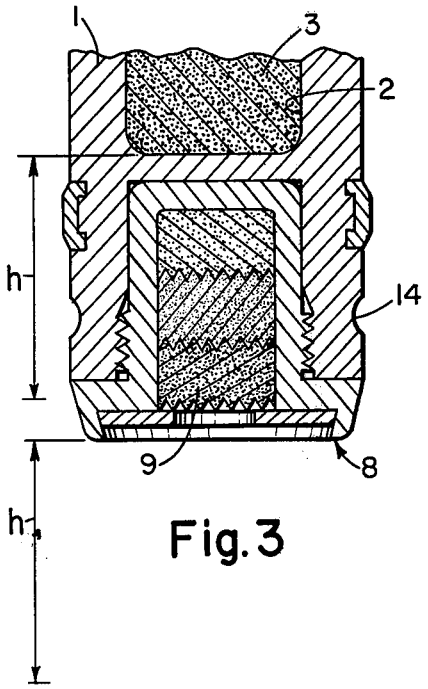
FIG. 3 illustrates a conventional projectile on the same scale as the inventive projectile.

The projectile body 1 possesses a notch groove 14 at which there is secured in conventional manner a not particularly illustrated cartridge sleeve. The notch groove 14 is located at the region of the explosive charge 3. In contrast thereto the corresponding notch groove with the prior art explosive projectile according to FIG. 3 is located at the region of the tracer composition. The hollow compartment 2 for the explosive charge 3 is therefore longer by the distance *h* than with the know projectile where the tracer composition extends by the distance *h* deeper into the non-illustrated cartridge sleeve.

In order that owing to this extension of the projectile there is not altered its ballistic properties, it is necessary that the projectile body 1 and the tracer composition sleeve are constructed to be correspondingly lighter in weight. This is achieved, as a comparison of FIGS. 1 and 3 will reveal, in that the tracer composition sleeve 8 is not threaded into the projectile body 1.

While there are shown and described present preferred embodiments of the invention, it is to be distinctly understood that the invention is not limited thereto, but may be otherwise variously embodied and practiced within the scope of the following claims.

What is claimed is:

1. An explosive projectile comprising in combination:

I. a projectile body possessing
  a. a hollow compartment for receiving an explosive charge,
  b. a notch groove for the attachment of a cartridge sleeve at the region of the explosive charge,
  c. a rear end surface,
  d. a border ring substantially coaxial with the projectile body and extending rearwardly from the rear end surface thereof;

II. a tracer composition sleeve secured to the projectile body and possessing
  a. a front end surface which sealingly bears at the rear end surface of the projectile body
  b. a flange at said front end surface with a substantially conical part surrounded by said border ring for interconnecting the projectile body and the tracer composition sleeve and wherein III. at least one of said rear end surface of the projectile body and said front end surface of the tracer composition sleeve having a substantially disc-shaped recess forming a substantially ring-shaped sealing contact surface between such rear and front end surfaces.

2. An explosive projectile according to claim 1, wherein said disc-shaped recess is provided in the rear end surface of said projectile body.

3. An explosive projectile according to claim 1, wherein said disc-shaped recess is provided in the front end surface of said tracer composition sleeve.

* * * * *